US009475613B2

(12) United States Patent
Kent

(10) Patent No.: US 9,475,613 B2
(45) Date of Patent: Oct. 25, 2016

(54) RIM MOUNTED POUR SPOUT FOR LARGE BUCKETS

(71) Applicant: David D. Kent, Santa Ana, CA (US)

(72) Inventor: David D. Kent, Santa Ana, CA (US)

( * ) Notice: Subject to any disclaimer, the term of this patent is extended or adjusted under 35 U.S.C. 154(b) by 0 days.

(21) Appl. No.: 14/522,374

(22) Filed: Oct. 23, 2014

(65) Prior Publication Data

US 2015/0232233 A1 Aug. 20, 2015

Related U.S. Application Data

(63) Continuation-in-part of application No. 29/482,453, filed on Feb. 18, 2014, now Pat. No. Des. 729,483.

(51) Int. Cl.
*B65D 5/72* (2006.01)
*B65D 25/48* (2006.01)
*B44D 3/12* (2006.01)

(52) U.S. Cl.
CPC ..... *B65D 25/48* (2013.01); *B44D 3/12* (2013.01)

(58) Field of Classification Search
CPC ..... B65D 25/48; B44D 3/12
USPC ..... 222/569–571; 220/571.1, 699, 700, 220/701, 729
See application file for complete search history.

(56) References Cited

U.S. PATENT DOCUMENTS 820,081 A * 5/1906 Alley et al. ..... B65D 25/20 220/698
853,493 A * 5/1907 Bradbury ..... B44D 3/128 220/700
861,305 A * 7/1907 McFadden ..... B44D 3/128 220/699
2,567,326 A * 9/1951 Entsminger ..... B44D 3/123 220/696
3,901,256 A * 8/1975 Habostad ..... B44D 3/006 134/138
4,225,064 A 9/1980 Westcott
4,240,568 A 12/1980 Pool
4,299,340 A * 11/1981 Hrytzak ..... 222/189.07
4,316,560 A 2/1982 Carter
5,078,872 A 1/1992 Durant et al.
5,123,576 A 6/1992 Lawrence
5,234,133 A 8/1993 Kensey
5,568,879 A 10/1996 Kovathana
5,579,963 A * 12/1996 Murthi ..... 222/570
D457,700 S 5/2002 Acord
6,983,869 B1 * 1/2006 Stevens ..... B65D 47/127 220/701
7,507,936 B2 * 3/2009 Mast ..... A45D 26/0014 15/236.01
7,726,510 B2 6/2010 Bootz
8,291,543 B2 * 10/2012 McCoy ..... A47J 47/18 15/257.1
8,757,453 B1 * 6/2014 Olsson ..... B65D 25/48 220/700
2003/0146225 A1 * 8/2003 Rojas ..... B44D 3/128 220/700
2015/0232233 A1 * 8/2015 Kent ..... B44D 3/12 222/570

* cited by examiner

*Primary Examiner* — Patrick M Buechner
(74) *Attorney, Agent, or Firm* — Roy A. Ekstrand

(57) ABSTRACT

A rim-mounted pour spout suitable for snap-fit attachment to a conventional five gallon paint bucket or the like includes an arcuate body having an upwardly and outwardly extending pour guide and a downwardly extending pressure wall. A plurality of spring clasps extending from the arcuate body are operative to secure the rim-mounted pour spout upon the host bucket rim in a manner maintaining a pressure seal between the pressure wall and the underlying inner surface of the bucket wall. The rim-mounted pour spout is readily formed of a molded plastic material or the like and may be suitably sized to accommodate a variety of different bucket containers.

11 Claims, 9 Drawing Sheets

RIM MOUNTED POUR SPOUT FOR LARGE BUCKETS

CROSS-REFERENCE TO RELATED APPLICATION

This application claims the benefit of and priority under 35USC 119(e) of U.S. patent application Ser. No. 29/482,453 entitled POUR SPOUT FOR A BUCKET, filed Feb. 18, 2014 in the name of David D. Kent, the disclosure of which is incorporated herein by reference.

FIELD OF THE INVENTION

The present invention relates generally to large volume containers for flowable materials and particularly to apparatus intended to aid in facilitating the pouring of the contents therefrom.

BACKGROUND OF THE INVENTION

Among the many commodities and products used commercially and industrially a substantial number of products may be generally described as "flowable". Thus, many products such as paint, chemicals, oils, food products, sauces as well as higher weight more viscous materials such as adhesives, pastes or even concrete or similar materials are often packaged in buckets or cans. One pervasive example is the well-known metal paint cans which typically provide product volume such as a gallon, quart or pint have enjoyed great popularity and use in the distribution of many of above identified products and commodities. A significant factor contributing to the popularity and pervasiveness of one gallon and other smaller size paint cans is their high degree of standardization. Virtually all containers of these type are formed of a metal material and conform to a basic common shape and style. Such metal containers often referred to metal paint cans are manufactured and supplied by a great number of container manufactures. However, the manufacturers all adhere to a standard rim size and rim contour for their metal paint cans. This standardization allows the use of a standard design paint can lid which engages and grips the paint can rim when pressed on to the container.

For the most part, and in most typical uses, the material within the paint cans is poured from the open can into other containers or the like. Confronted by the enormous popularity and pervasive use of metal paint cans and the associated need to aid in providing a method for clean drip free content pouring during use, practitioners in the container arts have developed a variety of aids and accessories to be used in pouring the contents from an open paint can.

For example, U.S. Pat. No. 5,568,879 issued to Kovathana which sets forth a VERSATILE AND UNIVERSAL PAINT CAN ATTACHMENT for use on all nominal sized paint cans and the like. The attachment is designed to snap-fit on top of an open paint can to protect the lid receiving groove of the paint can from accumulating paint during the painting process. The attachment defines a shape corresponding to an annular ring. A flexible annular ledge provides for sealingly engaging the inner peripheral bead of the paint can rim. A shelf extending from the annular ring provides a support surface for a paint brush during use.

U.S. Pat. No. 4,240,568 issued to Pool sets forth an ATTACHMENT FOR LIQUID CARRYING CONTAINER which includes a detachably engagable brim having an annular ledge which sealingly resides over the gutter of the paint can rim. The ledge includes an upstanding outer peripheral rim which redirects fluid into the container. A screen filters fluid passing from the container to a pouring spout formed integrally with the annular ledge.

U.S. Pat. No. 4,316,560 issued to Carter sets forth a PAINT CAN DISPENSING RING ATTACHMENT having a conical annular ring snap-fit attached to the upper rim of a metal paint can. The conical portion of the annual ring terminates in an angled inwardly extending downwardly directed wall which is integrally formed with the conical ring. The conical incline and angled wall cooperate to redirect paint into the container and shield the gutter of the paint can.

U.S. Pat. No. 5,234,133 issued to Kensey sets forth a CONTAINER POURING ATTACHMENT WITH REPLACABLE POURING STRUCTURES having a resilient semi-ridged semi-flexible annular split retainer for mounting about the interior of a paint container rim. A plurality of different pouring structures, such as a spout, funnel and filter are removably mountable to the split retainer. A pouring attachment extends downwardly into the interior of the paint can to provide a path for flow of the final portion of the fluid from the container to and over the pouring structure of the pouring attachment.

U.S. Pat. No. 4,225,064 issued to Westcott sets forth a PAINTER'S ACCESSORY having a body formed of a slightly elastic material defining an inner wall and an outer wall spaced by a generally radial interconnecting web. A sealing ridge projects from the inner wall toward the outer wall and a pouring lip and service lip extends outwardly and inwardly of the walls.

U.S. Pat. No. 7,726,510 issued to Bootz sets forth a BRUSH WIPING DEVICE AND METHOD OF USE which includes a generally annular rim seeded to the container rim in a snap-fit attachment. Surfaces are provided for retaining and cleaning a paint brush during use.

U.S. Pat. No. D457,700 issued to Acord sets forth a PAINT CAN ATTACHMENT design configured to be received upon the upper rim of an open paint can.

While the foregoing devices have been somewhat successful in meeting the need for pour spouts and the like to be used in combination with metal paint cans, larger volume containers such as the ubiquitous "five gallon bucket" have been largely unobtainable. Unlike their highly standardized metal paint can cousins, large volume containers such as five gallon buckets have not evolved into a standard rim size and rim contour. For the most part, typical five gallon buckets and the like are not made of metal such as one gallon paint cans and the like. Rather, five gallon buckets tend to be molded plastic buckets and as a result facilitate each manufactures preference of different rim structures and rim configurations. In addition, different manufactures of molded plastic five gallon buckets utilize different material wall thicknesses and reinforcing and strengthening ribs as they accommodate different types of material within the five gallon bucket.

One important result of the lack of standardization of five gallon bucket design and manufacture has been the frustration of efforts by practitioners in the container arts to provide the types of accessories and pour spouts presently available for metal paint cans and the like. While practitioners have made attempts to provide such pour spouts and accessories, the result has not enjoyed the level of consistency, quality and effectiveness obtained by those associated with the above-described metal paint cans.

Despite the many problems of attempting to provide pour spouts and other similar accessories for molded plastic five gallon buckets, the need in the art has driven practitioners to nonetheless make various attempts. For example, U.S. Pat. No. 5,078,872 issued to Durant et al sets forth a COMBINED STRAINER AND POUR SPOUT APPARATUS utilized for pouring and straining material within an open five gallon bucket or the like. The apparatus includes a pour spout member preferably made of a simple dye cut paper shape and a strainer member preferably formed as a dye cut triangular mesh affixed one edge of the spout member. An interface portion is contiguous with spout member and extends downwardly into the bucket interior resting against the interior surface of the bucket. The interface portion rests loosely against the bucket interior surface and is secured thereto by a "peel-off" tape which aids in maintaining the combined strainer and pour spout to the bucket.

An alternative structure has been provided by practitioners in the art in attempting to aid the user in pouring flowable contents from a five gallon bucket type container. In this approach, practitioners in the art provide a "bunghole" in the bucket lid. The bunghole is closed by a thread on cap for seal during shipping and storage. When the need arises to pour the flowable contents from the five gallon bucket, the screw-on cap is removed and an elongated cylindrical spout having a screw attachment end is substituted for the screw-on cap. With the spout thus attached, flowable material may be poured outwardly through the spout as the bucket is raised and tilted. While the use of a screw-on spout meets the needs of certain specialized applications, in terms of general use in pouring flowable material from a five gallon bucket it is subject to substantial limitations. The closed generally cylindrical structure of the spout does not permit air to enter the bucket as material is poured from it. The result is bubbling of the liquid and erratic flow patterns which are undesirable and unacceptable for most applications.

In view of the foregoing, it becomes clear that there remains a long standing and unresolved need in the art for a simpler more effective and more reliable apparatus which aids in the pouring of flowable contents from a container such as a five gallon molded plastic bucket. There remains a further need for such an aid which accommodates the size and structural variations of such molded plastic five gallon containers and the like while accommodating all with sufficient integrity to avoid undue dripping and spilling of the poured contents.

SUMMARY OF THE INVENTION

Accordingly, it is a general object of the present invention to provide an improved pour spout for use in molded plastic five gallon buckets and the like. It is a more particular object of the present invention to provide an improved pour spout for use in molded plastic five gallon buckets and the like which provides a rim mounted pour spout in a snap-fit attachment. It is a still further object of the present invention to provide an improved rim-mounted pour spout for large buckets which snap fits a variety of bucket designs and provides a spring clasp and pressure wall to maintain sealing engagement with the upper portion of the five gallon bucket.

In accordance with the present invention there is provided a rim mounted pour spout for use in combination with a bucket having an upper rim and rim bead, the rim mounted pour spout comprising: an arcuate body curved to correspond generally to a bucket rim; a pour guide, supported by the arcuate body, extending upwardly and outwardly from the arcuate body; a pressure wall extending downwardly from the pour guide and defining a generally cylindrical wall surface; and a plurality of spring clasps extending downwardly from the arcuate body each of the spring clasps including a curved portion and a supporting spring arm, the rim mounted pour spout being snap fit attachable to a bucket rim such that the pressure wall extends into the bucket and is pressed against the bucket wall by the spring clasps.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
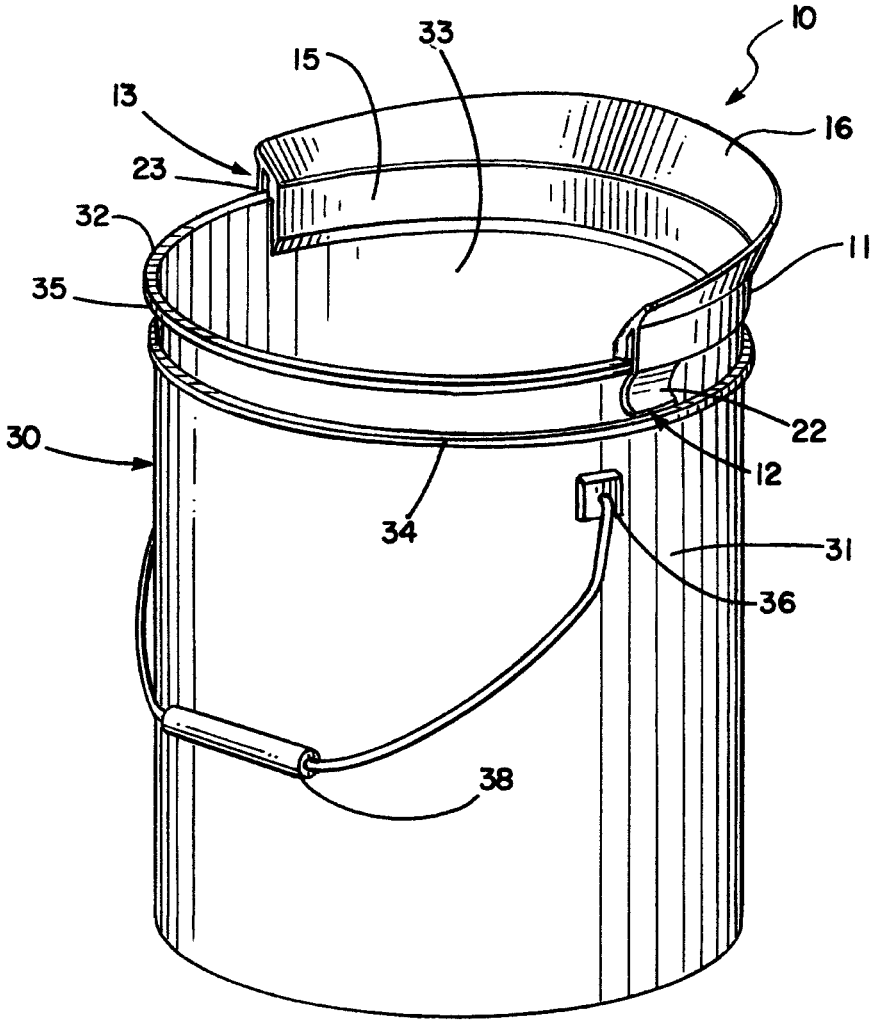
FIG. 1 sets forth a perspective view of the present invention rim-mounted pour spout for large buckets secured to an illustrative five gallon paint bucket.

FIG. 1 sets forth a rim-mounted pour spout for large buckets constructed in accordance with the present invention and generally referenced by numeral 10. Rim-mounted pour spout 10 is shown secured to a conventional five gallon paint bucket generally referenced by numeral 30. Five gallon paint bucket 30 is constructed in accordance with conventional fabrication and is formed of a molded plastic material and defines a generally cylindrical bucket wall 31. Wall 31 terminates in an upper rim 32 which in turn defines an outwardly extending rim bead 35. Bucket wall 31 further defines a reinforcing rib 34 and an interior bucket wall surface 33. In further accordance with conventional fabrication techniques, bucket 30 includes a pair of handle attachments 36 and 37 (attachment 37 seen in FIG. 3). In further accordance with conventional fabrication techniques, a metal wire handle 38 is pivotally secured to handle attachments 36 and 37. Once again, it will be understood that five gallon bucket 30 is provided solely for illustration of the present invention pour spout and is entirely constructed in accordance with conventional fabrication techniques.

In accordance with the present invention, pour spout 10 includes an arcuate body 11 supporting a downwardly extending pressure wall 15. Pour spout 10 includes a plurality of spring clasps 12, 13 and 14 (clasp 14 shown in FIG. 2). Body 11 of pour spout 10 further includes a gently sloped pour guide surface 16 which extends upwardly and slightly outwardly from pressure wall 15. Pour guide 16 terminates in an upper edge 17. The structure of clasps 12, 13 and 14 (seen in FIG. 2) is set forth below in FIGS. 4, 5 and 6 in greater detail. However, suffice it to note here that clasps 12, 13 and 14 define respective inwardly curved clasp spring tabs 22, 23 and 24 respectively (clasp spring tab 24 seen in FIG. 2). As is also described below in greater detail, clasp spring tabs 22, 23 and 24 are operative to secure pour spout 10 in the attachment shown in FIG. 1. Of particular importance in accordance with the present invention and as is described more fully below, clasp spring tabs 22, 23 and 24 (seen in FIG. 2) maintain a pressure contact between pressure wall 15 of pour spout 10 and the underlying portion of interior wall surface 33 of bucket 30.

In operation and as is set forth below in greater detail, pour spout 10 is secured to rim 32 of bucket 30 by arcuate body 11 and the grasp provided by clasps 12, 13 and 14 (seen in FIG. 2). In further accordance with the present invention, the pressure contact of pressure wall 15 against inner wall surface 33 of bucket 30 provides a tight seal between pour spout 10 and inner wall 33 ensuring that the contents of bucket 30 when poured from bucket 30 over pour guide 16 and edge 17 of pour spout 10 flow entirely across pour guide 16 and do not pass beneath pressure wall 15. An example of the pouring action is set forth in FIG. 7 in greater detail. However, suffice it to note here that the position of pressure wall 15 against interior wall surface 33 of bucket 30 ensures that none of the contents within bucket 30 pass beneath pressure wall 15 and into the interior of pour spout 10. As a result, the contents within bucket 30 may be poured outwardly from bucket 30 with the entire upper surface of the bucket exposed to atmospheric pressure. This in turn provides a "open air" unrestricted flow of material without the need to provide air venting or other similar function as is the case with the above-described pour spouts provided in the art. It will be noted that pour spout 10 is joined to bucket 30 by forcing pour spout 10 downwardly upon rim 32 overcoming the spring force provided by clasp spring tabs 22, 23 and 24 (seen in FIG. 2). In the manner set forth below in FIG. 4, the force upon pour spout 10 drives rim 32 and rim bead 35 upwardly flexing clasp spring tabs 22, 23 and 24 (seen in FIG. 2) outwardly as rim bead 35 passes beneath clasp spring tabs 22, 23 and 24. As rim bead 35 passes into the interior of body 11, the spring force of clasp spring tabs 22, 23 and 24 causes the spring tabs to snap inwardly and provide a retaining force against bucket wall 32 beneath rim bead 35. Removal of pour spout 10 from bucket 30 is carried forward in substantially the reverse operation as pour spout 10 is drawn upwardly again forcing rim bead 25 to flex clasp spring tabs 22, 23 and 24 (seen in FIG. 2) outwardly allowing rim bead 35 to be removed from body 11 of pour spout 10.

It will be apparent to those skilled in the art that while pour spout 10 is illustrated in its application to a molded plastic conventional five gallon paint bucket, the present invention rim-mounted pour spout is capable of use with a variety of larger bucket-like containers without departing from the spirit and scope of the present invention. As mentioned above, containers similar to bucket 30 are prevalent in various industries and are not limited to the paint industry. Accordingly, the variety of buckets utilized for example in food industries, chemical industries, agricultural industries and the like are capable of benefiting equally well from the use of the present invention pour spout. Thus, the present invention pour spout should under no circumstances be considered limited in its application to five gallon paint buckets.

Figure 2:
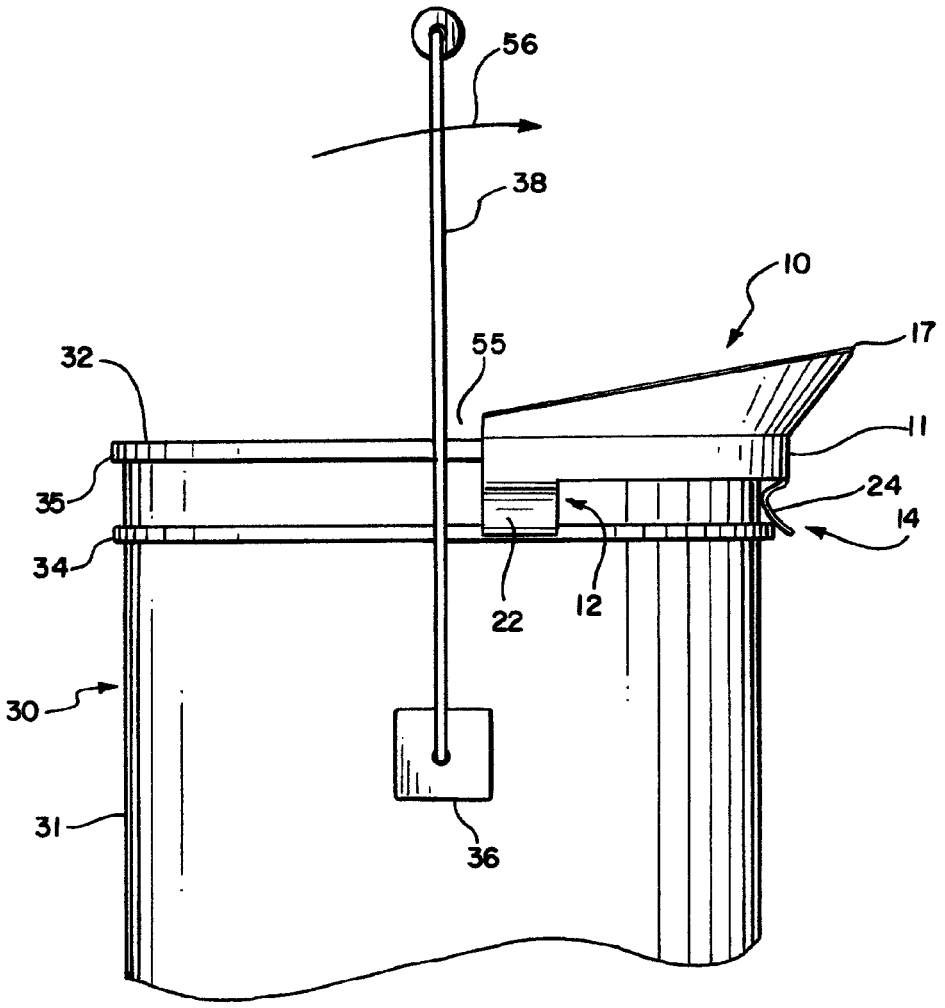
FIG. 2 sets forth a side view of the present invention rim-mounted pour spout for large buckets secured to a conventional five gallon paint bucket.

FIG. 2 sets forth a side elevation view of bucket 30 shown in FIG. 1 having rim-mounted pour spout 10 secured thereto. As described above, bucket 30 is conventional in fabrication formed of a molded plastic material or the like and including a generally cylindrical bucket wall 31 which terminates in an upper rim 32. As is also described above, rim 32 includes an outwardly extending rim bead 35. In further accordance with the above descriptions, wall 31 further supports a reinforcing rib 34. A handle attachment 36 supports one end of a conventional pivotable handle 38. Handle 38 is pivotally supported and is movable from the downwardly extending position shown in FIG. 1 to the raised position shown in FIG. 2 by pivotal movement of handle 38 in the direction indicated by arrow 56.

In accordance with the present invention, rim-mounted pour spout 10 is secured upon rim 32 and captivates rim bead 35 in the manner described below in FIG. 4 in greater detail. Suffice it to note here that pour spout 10 includes an arcuate body 11 which supports a plurality of clasps 12, 13 and 14 (clasp 13 in seen in FIG. 3). In further accordance with the operation set forth below in FIG. 4 in greater detail, clasps 12, 13 and 14 include clasp spring tabs 22, 23 and 24 (clasp spring tab 23 shown in FIG. 3) which extend downwardly and inwardly against the underlying portions of bucket wall 31 to provide the above-described attachment. Of particular importance to note in FIG. 2, the upward or raised position of handle 38 which is used in carrying or holding bucket 30 positions handle 38 in a substantially vertical alignment with respect to bucket 30. It is also important to note that rim-mounted pour spout 10 does not extend to the portion of rim 32 which underlies handle 38 in this carrying position. Rather, the end portion of clasp 12, terminates short of handle 38 and provides a clearance gap 55 therebetween. While not seen in FIG. 2, it will be understood that a similar clearance gap is provided between clasp 13 (seen in FIG. 3) and handle 38. As a result, rim-mounted pour spout 10 may be secured to rim 32 of bucket 30 without interfering with the carrying of bucket 30 by grasping handle 38.

Figure 7:
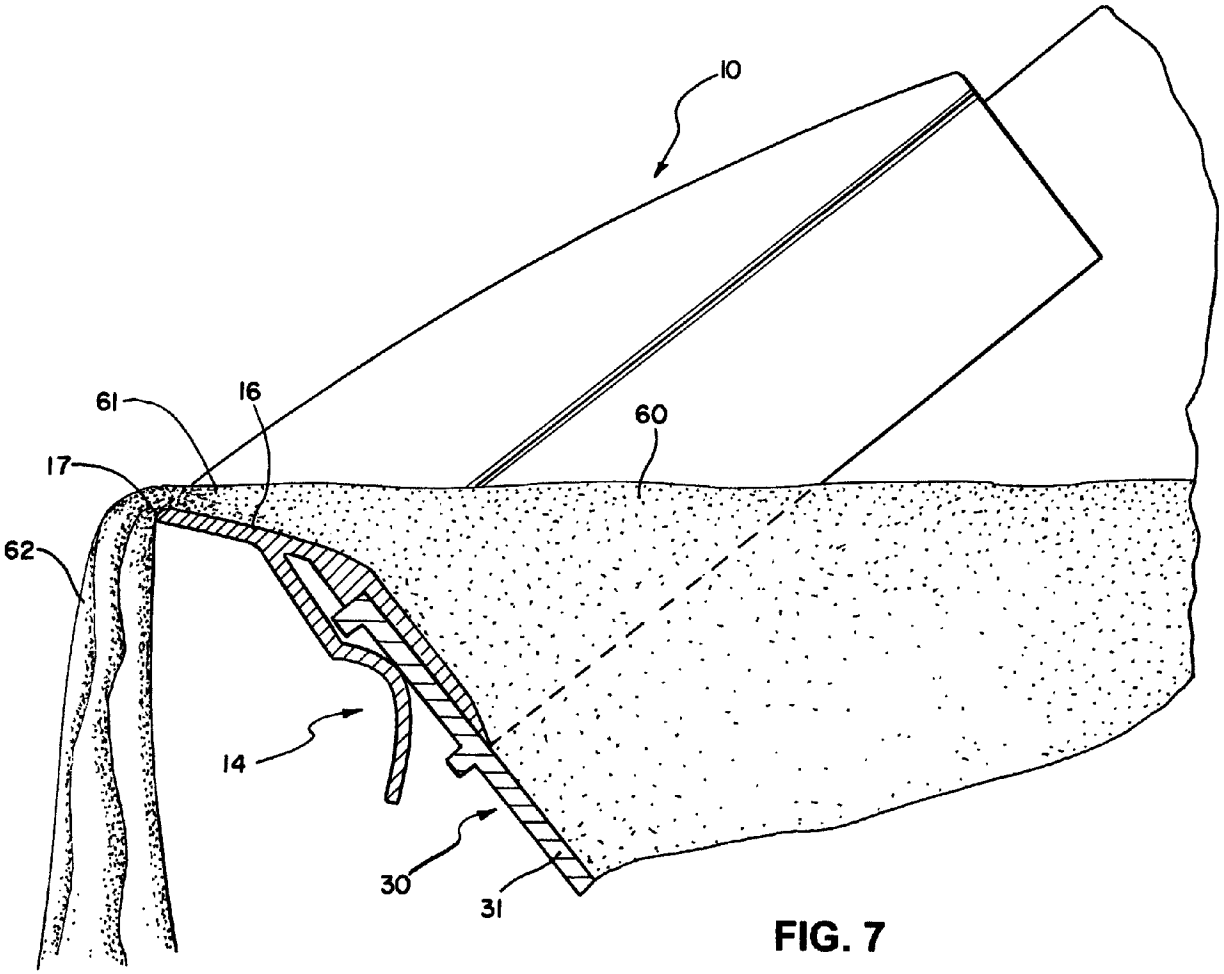
FIG. 7 sets forth a partial section view of the present invention rim-mounted pour spout for large buckets secured to a five gallon paint bucket and illustrating the material pouring action of the present invention.

FIG. 2 also provides an important illustration of the forward extension of pour guide 16 (seen in FIG. 1) which places edge 17 well beyond bucket wall 31. In this manner, the effective discharge of material poured from bucket 30 as illustrated in FIG. 7 avoids any material drip or deposit upon bucket wall 31 as bucket 30 is tilted to discharge the contents therefrom.

Figure 3:
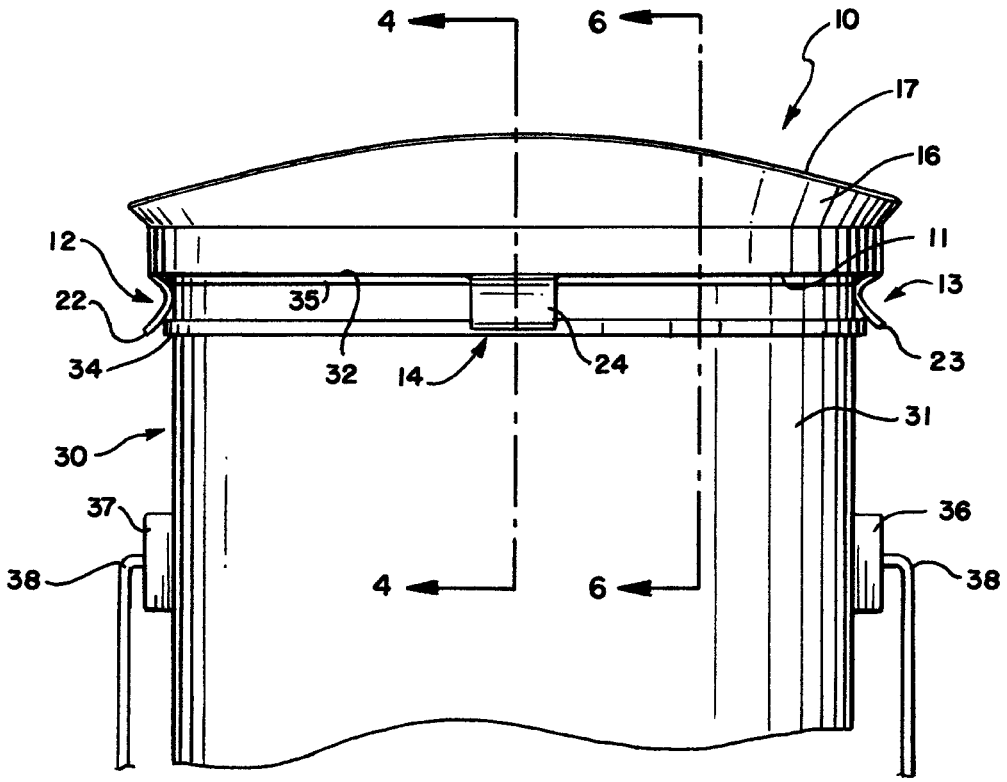
FIG. 3 sets forth a front view of the present invention rim-mounted pour spout for large buckets secured to a typical five gallon paint bucket.

FIG. 3 sets forth a front view of rim-mounted pour spout 10 secured to bucket 30 in the manner shown in FIG. 1. As described above, bucket 30 includes a cylindrical wall 31 supporting a reinforcing rib 34 and defining an upper rim 32. Rim 32 includes an outwardly extending rim bead 35. In accordance with the above-described conventional fabrication, bucket 30 further includes a pair of handle attachments 36 and 37 having a handle 38 pivotally secured thereto.

In accordance with the present invention, rim-mounted pour spout 10 is received upon and secured to rim 32 and engaging rim bead 35. Rim-mounted pour spout 10 further includes an arcuate body 11 supporting a plurality of clasps 12, 13 and 14 which in turn include clasp spring tabs 22, 23 and 24. As mentioned above and as is described below in FIG. 4 in greater detail, clasps 12, 13 and 14 utilize clasp spring tabs 22, 23 and 24 to engage rim 32 and rim bead 35 to maintain the secure attachment of rim-mounted pour spout 10. As is also described above, rim-mounted pour spout 10 includes an upwardly and outwardly angled pour guide 16 which terminates in an upper edge 17.

Figure 4:
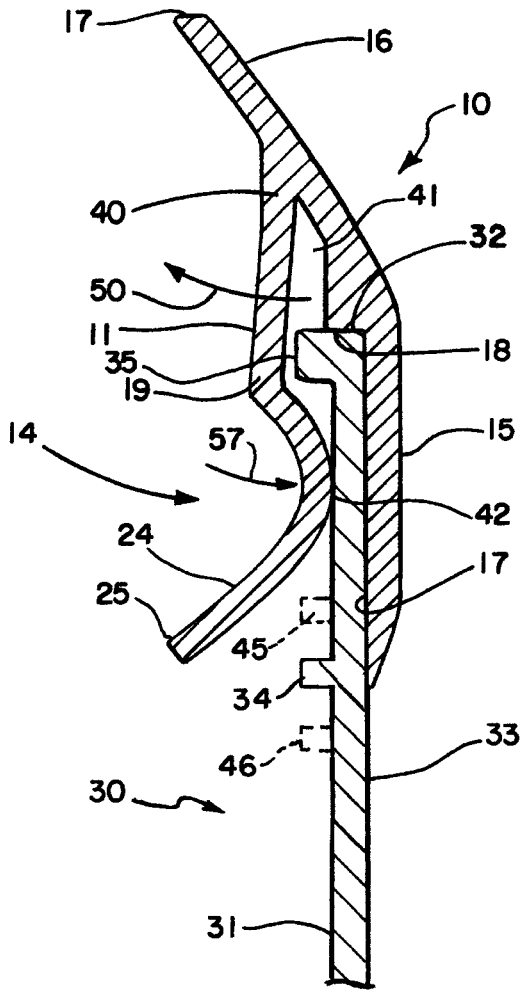
FIG. 4 sets forth a partial section view of the present invention rim-mounted pour spout for large buckets taken along section lines 4-4 in FIG. 3.

FIG. 4 sets forth a section view of rim-mounted pour spout 10 secured to a typical five gallon bucket 30 which is taken along section lines 4-4 in FIG. 3. In the configuration shown in FIG. 4, rim-mounted pour spout 10 is snap-fit attached to the upper rim of a five gallon bucket 30. In this configuration, rim-mounted pour spout 10 is fully secured to bucket 30 such that the underlying rim portion is fully covered and protected by rim-mounted pour spout 10.

More specifically, rim-mounted pour spout 10 includes an arcuate body 11 supporting an upwardly and outwardly angled pour guide 16 which terminates in an upper edge 17. Arcuate body 11 extends downwardly to form a spring arm 19 which in turn forms an inwardly curved clasp 14. Clasp 14 defines a curved portion 24 and an outwardly extending tab 25. Rim-mounted pour spout 10 further includes a downwardly extending pressure wall 15 which is integrally formed with the lower end of pour guide 16 and which further defines a step portion 18. A gap 41 exists between step 18 and spring arm 19. Spring arm 19 further defines a flex point 40 in the region generally proximate to the junction of spring arm 19 and pour guide 16. The position of clasp 14 and the curved structure of curved portion 24 defines a pressure point 42 against wall surface 17 of pressure wall 15.

As described above, bucket 30 is constructed entirely in accordance with conventional fabrication techniques and forms a typical five gallon paint bucket. It will be equally apparent to those skilled in the art however that while bucket 30 utilizes a conventional five gallon paint bucket for illustration, the present invention rim-mounted pour spout is suitable for application to five gallon buckets which are used in combination with virtually any material such as the above-described uses. It will be equally apparent to those skilled in the art that the present invention rim-mounted pour spout is by no means limited to a five gallon paint bucket. On the contrary, it will be apparent to those skilled in the art that other containers of different sizes and dimension may be combined with a correspondingly proportioned and sized version of the present invention rim-mounted pour spout without departing from the spirit and scope of the present invention.

Thus, bucket 30 is shown in FIG. 4 to define a bucket wall 31 having an inner wall surface 33 and an upper rim 32. Rim 32 further defines an outwardly extending rim bead 35. In further accordance with the conventional fabrication of bucket 30, bucket wall 31 further supports a reinforcing rib 34. As is well known in the container arts, large volume buckets such as bucket 30 typically employ different combinations and arrangements of reinforcing members such as reinforcing rib 34. Thus, a plurality of differently placed reinforcing ribs are illustrated in phantom-line depiction as reinforcing ribs 45 and 46. Ribs 34, 45 and 46 will be understood to be merely illustrative of the variety of reinforcing rib structures utilized by bucket manufacturers to strengthen the bucket sidewall.

In the attachment shown in FIG. 4 which is also illustrative of the attachment between clasps 12 and 13 (seen in FIG. 3) by which rim-mounted pour spout is secured to bucket 30 shows rim 32 and rim bead 35 having been pressed into the space between clasp 14 and pressure wall 15, which includes a surface tapered towards the underlying portion of interior wall 33, such that the underlying portion of interior wall 22 of bucket 30 is in contact with wall surface 17 of pressure wall 15. In addition, rim-mounted pour spout 10 has been forced downwardly upon rim 32 such that step 18 of pressure wall 15 is in contact with the underlying surface of rim 32. In accordance with the invention as rim-mounted pour spout 10 is forced downwardly upon rim 32 in the attachment of the rim-mounted pour spout, spring arm 19 is flexed outwardly in the direction indicated by arrow 50 which enlarges gap 41 and which pivots clasp 14 away from pressure wall 15 allowing the expanded dimension of rim bead 35 to be forced beneath and past curved portion 24 of spring arm 19. Once curved portion 24 have moved beyond rim bead 35, the resilient spring force of spring arm 19 acting generally at flex point 40 provides a closing spring force which urges curved portion 24 and spring arm 19 in the direction indicated by arrow 57. Thus, the spring force of spring arm 19 exerts a spring force which drives curved portion 24 against the underlying portion of bucket wall 31 at a contact region 42. This spring force is operative about flex point 40 and thus draws pressure wall 15 against inner surface 33 of bucket 30 as surface 17 of pressure wall 15 is forced against inner surface 33. In essence, clasp 14 provides a "pincer" grip against inner wall surface 33 of bucket 30. In turn, this pincer force maintains a tight seal between surface 17 of pressure wall 15 and the underlying portion of inner surface 33. As is described below in FIG. 7 in greater detail, this pincer force causes material within bucket 30 to pass over pressure wall 15 and pour guide 16 rather than pass further up inner wall 33. This provides an important seal action which protects rim 32 beneath pour guide 16.

Figure 5:
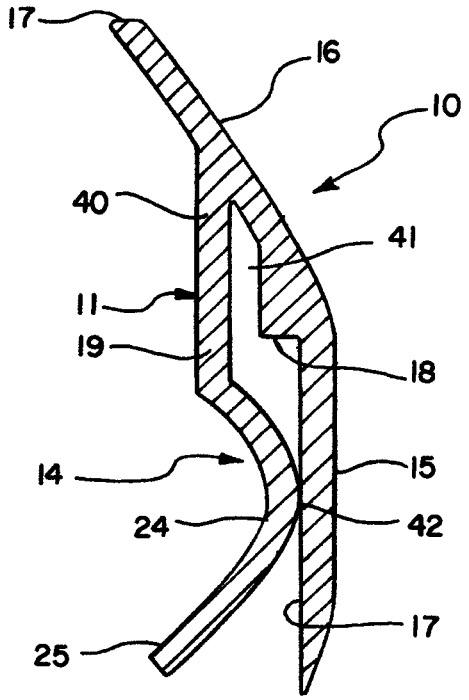
FIG. 5 sets forth a section view of the present invention rim-mounted pour spout for large buckets in a relaxed position separated from the five gallon bucket shown in FIG. 4.

FIG. 5 sets forth a section view of rim-mounted pour spout 10 taken along section lines 4-4 showing rim-mounted pour spout 10 in a relaxed position prior to assembly in the manner shown in FIG. 4. The operation of clasp 14 and the remainder of rim-mounted pour spout 10 will be readily understood by comparing the relaxed configuration of FIG. 5 with the attached configuration of FIG. 4.

More specifically, rim-mounted pour spout 10 includes an arcuate body 11 supporting an upwardly and outwardly angled pour guide 16 which terminates in an upper edge 17. Arcuate body 11 extends downwardly to form a spring arm 19 which in turn forms an inwardly curved clasp 14. Clasp 14 defines a curved portion 24 and an outwardly extending tab 25. Rim-mounted pour spout 10 further includes a downwardly extending pressure wall 15 which is integrally formed with the lower end of pour guide 16 and which further defines a step portion 18. A gap 41 exists between step 18 and spring arm 19. Spring arm 19 further defines a flex point 40 in the region generally proximate to the junction of spring arm 19 and pour guide 16. The position of clasp 14 and the curved structure of curved portion 24 defines a pressure point 42 against wall surface 17 of pressure wall 15.

With simultaneous reference to FIGS. 4 and 5, the action of clasp 14 may be readily understood. At the outset, it will be remembered that each of clasps 12, 13 and 14 (clasps 12 and 13 seen in FIG. 3) are substantially identical. Accordingly, the detailed descriptions set forth in FIGS. 4 and 5 relating to the structure and operation of clasp 14 will be understood to apply with equal force and description to the structure and operations of clasps 12 and 13. It will be noted that in the relaxed position shown in FIG. 5, the spring force between spring arm 19 and pour guide 16 operative at flex point 40 urges curved portion 24 of spring arm 19 into contact with wall surface 17. At contact pressure point 42, the force of spring arm 19 forces curved portion 24 against wall surface 17 of pressure wall 15. By comparison, the configuration of clasp 14 when rim-mounted pour spout 10 is received upon and attached to rim 32 and rim bead 35 of bucket 30 is maintained by the spring force exerted by spring arm 19 which captivates and grips a portion of bucket wall 31 between curved portion 24 and pressure wall 15. Thus, a spring force continues to be exerted against bucket wall 31 by spring arm 19 which also draws pressure wall 15 against interior wall surface 33 of bucket wall 31. In this manner, the seal between surface 17 of pressure wall 15 and the underlying portion of wall surface 33 of bucket wall 31 is maintained.

Figure 6:
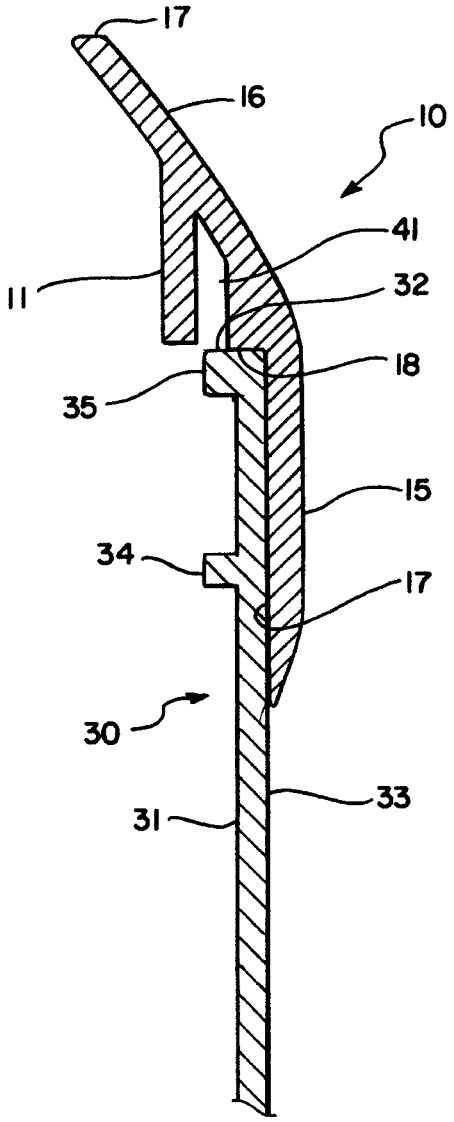
FIG. 6 sets forth a partial section view of the present invention rim-mounted pour spout for large buckets secured to a five gallon paint bucket and taken along section lines 6-6 in FIG. 3.

FIG. 6 sets forth a section view of rim-mounted pour spout 10 taken along section lines 6-6 in FIG. 3. It will be noted with temporary reference to FIG. 3 that rim-mounted pour spout 10 is attached to a conventional five gallon bucket 30. Returning to FIG. 6 and as is described above, bucket 30 is of conventional fabrication and includes a bucket wall 31 defining an interior wall surface 33 together with an upper rim 32. Rim 32 in turn defines an outwardly extending rim bead 35. Bucket wall 31 also includes a reinforcing rib 34 operative to strengthen bucket wall 31. As is also described above, rim-mounted pour spout 10 includes an arcuate body 11 having an angled pour guide 16 extending upwardly and outwardly therefrom. Pour guide 16 terminates in an upper edge 17. Arcuate body 11 further includes a step 18 and a downwardly extending pressure wall 15. Pressure wall 15 defines a wall surface 17 extending upwardly to step 18. A gap 41 is formed within arcuate body 11 extending upwardly from step 18.

In the configuration shown in FIG. 6, rim-mounted pour spout 10 is secured to rim 32 of bucket 30 in the manner set forth above utilizing clasps 12, 13 and 14 (seen in FIG. 3). It will be noted that FIG. 6 sets forth the combination of rim-mounted pour spout 10 and the attached portion of bucket 30 between clasps and accordingly spring arm 19 is not seen. By the above-described clasping action of clasps 12, 13 and 14 (seen in FIG. 3), wall surface 17 of pressure wall 15 is maintained against interior wall surface 33 of bucket wall 31. Similarly, step 18 of arcuate body 11 is maintained in contact with the upper surface of rim 32.

FIG. 7 sets forth a partial section view of rim-mounted pour spout 10 secured to bucket 30 in the above-described manner and further illustrating the flowable material pouring process. Thus in FIG. 7, the flow of material as bucket 30 supporting rim-mounted pour spout 10 is tilted to provide a discharge flow is illustrated. It will be recalled that the material utilized within bucket 30 may comprise virtually any flowable material.

More specifically, rim-mounted pour spout 10 includes an arcuate body 11 supporting an upwardly and outwardly angled pour guide 16 which terminates in an upper edge 17. Arcuate body 11 extends downwardly to form a spring arm 19 which in turn forms an inwardly curved clasp 14. Clasp 14 defines a curved portion 24 and an outwardly extending tab 25. Rim-mounted pour spout 10 further includes a downwardly extending pressure wall 15 which is integrally formed with the lower end of pour guide 16 and which further defines a step portion 18. A gap 41 exists between step 18 and spring arm 19. Spring arm 19 further defines a flex point 40 in the region generally proximate to the junction of spring arm 19 and pour guide 16. The position of clasp 14 and the curved structure of curved portion 24 defines a pressure point 42 against wall surface 17 of pressure wall 15.

In the partial section view shown in FIG. 7, bucket 30 is shown supporting a quantity of flowable material 60. As mentioned above, flowable material 60 may be a liquid such as paint or certain chemicals or may be a more viscous material such as food products or the like forming virtually any flowable material which may be stored and transported within bucket 30. As bucket 30 is tilted, flowable material 60 forms a stream of material 61 which passes outwardly across pressure wall 15 and pour guide 16 to fall from rim-mounted pour spout 10 as it crosses over and beyond edge 17. As the flowable material streams and falls from rim-mounted pour spout 10, it forms a discharge flow 62 which under the influence of gravity flows downwardly from edge 17. It is important to note that unlike the above-mentioned prior art pour spouts provided in attempts to facilitate pouring flowable material from a conventional five gallon paint can, the operation of rim-mounted pour spout 10 exposes flowable material 60 to open air and no restriction of flow or air replenishment within bucket 30 occurs. This open air pouring provides substantial advantage over prior art pour spouts.

Figure 8:
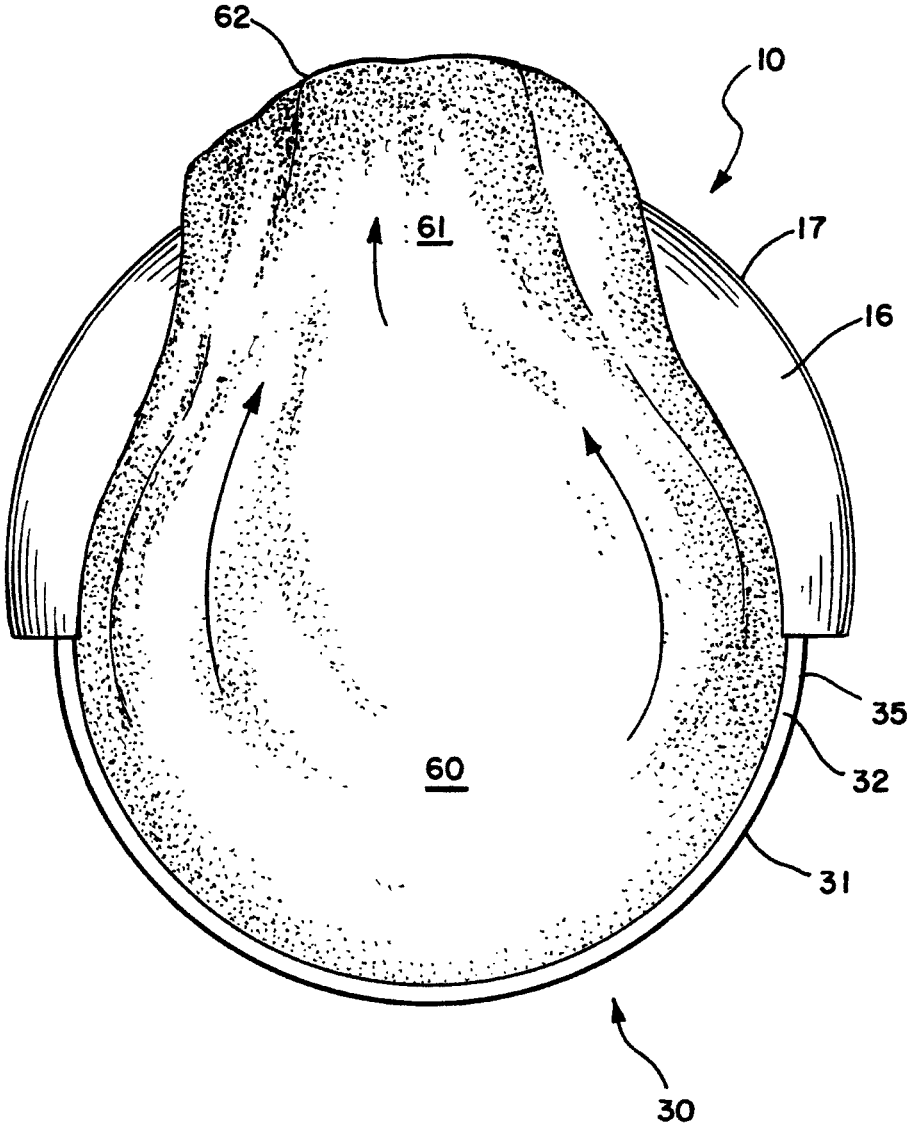
FIG. 8 sets forth a top view of the present invention rim-mounted pour spout for large buckets illustrating the pouring action of the present invention.

FIG. 8 sets forth a top view of conventional bucket 30 supporting the present invention rim-mounted pour spout during the material pouring operation shown in FIG. 7. Thus, bucket 30 which as mentioned above is fabricated in accordance with conventional fabrication techniques includes a bucket wall 31 supporting an upper rim 32 and outwardly extending rim bead 35. As is also described above, rim-mounted pour spout 10 includes a pour guide 16 which provides a directing surface for material flow during material discharge. Pour guide 16 defines an edge 17. As indicated in FIG. 7, bucket 30 is shown supporting a quantity of flowable material 60 which as bucket 30 is being tilted forms a discharge stream 61 traveling outwardly across pour guide 16 and ultimately traveling past edge 17 to descend in a discharge stream 62. It will be noted that the contour of pour guide 16 tends to direct discharge flow 61 with some confinement whereby the flowable material discharge does not travel outwardly beyond the extent of rim-mounted pour spout 10. This confining action provides a very desirable pouring and discharge characteristic.

Figure 9:
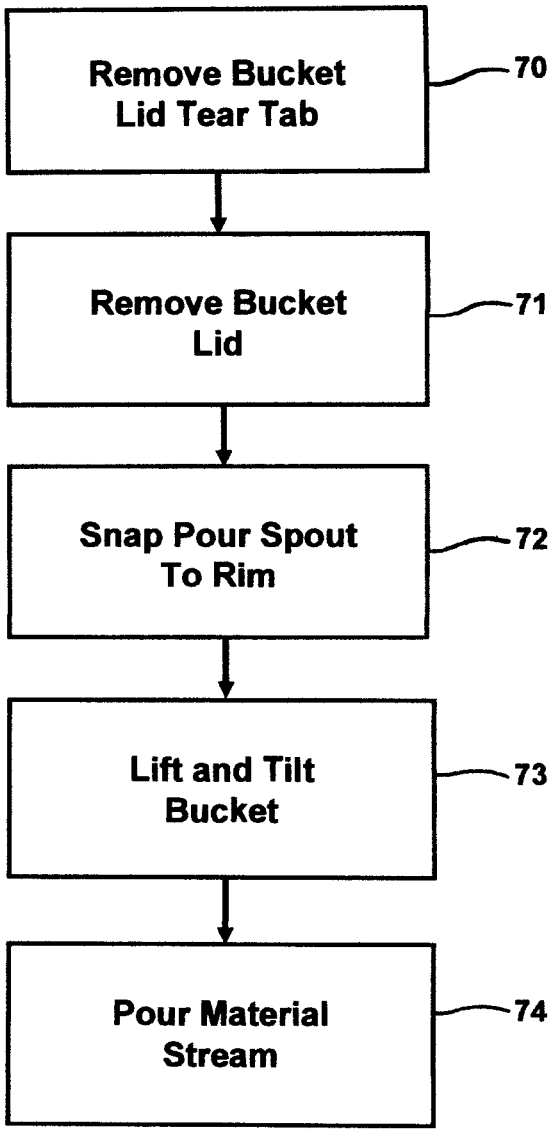
FIG. 9 sets forth a block diagram illustrating the method of use of the present invention rim-mounted pour spout for large buckets.

FIG. 9 sets forth a block diagram of the method of use of the present invention rim-mounted pour spout in conjunction with a conventional five gallon bucket of the type which utilizes a "tear tab" securing the bucket lid to the upper rim of the bucket. The method is initiated at a step 70 in which the plastic perimeter tear tab is removed from the five gallon bucket lid. Thereafter, the method moves to a step 71 in which the bucket lid is removed by lifting the individual plastic tabs or latches spaced about the perimeter of the lid. This tab lifting may be accomplished in a hand operation using the user's thumb and fingers or, alternatively, a specialized five gallon lid prying tool supplied by manufacturers may be employed. Once the bucket lid has been removed at step 71, the method moves to step 72 at which a rim-mounted pour spout constructed in accordance with the present invention in the manner described above is pressed downwardly and snapped to the upper rim and rim bead of the five gallon bucket. Following attachment of the rim-mounted pour spout at step 72, the method moves to step 73 in which the bucket containing a flowable material and supporting the above-described rim-mounted pour spout is lifted and tilted to produce a discharge stream of flowable material in the manner shown in FIGS. 7 and 8 and described above. Finally, at step 74 the flowable material is poured from the host bucket as the user selects the desired bucket tilt angle to disperse a smoothly flowing properly sized stream of flowable material. It will be noted that, unlike the above-described prior art spout apparatus, the present invention method and apparatus does not create a "vacuum lock" leading to bubbling, surging, gurgling and splattering of the discharge flow.

What has been shown in a rim-mounted snap-fit pour spout for large buckets such as conventional five gallon paint buckets. The rim-mounted pour spout is securable to the bucket rim in a snap-fit attachment through the provision of a plurality of spring clasps which engage and secure the rim-mounted pour spout to the bucket rim and bead. The rim-mounted pour spout supports a downwardly extending pressure wall which is maintained in contact with the underlying bucket wall surface in a sealing attachment. Flowable material poured from the bucket passes over the pressure wall and across the pour guide of the rim-mounted pour spout without contacting the underlying portion of the bucket rim or bead. The material flow provides an open air vacuum-free discharge of flowable material.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A rim mounted pour spout and large volume bucket combination comprising:

a large volume bucket having a substantially cylindrical bucket wall defining an interior bucket wall surface, an upper rim and outwardly extending rim bead formed on the top of said bucket wall and at least one reinforcing rib encircling and extending outwardly from said bucket wall at a distance from said rim bead;

an arcuate body curved to correspond to said bucket rim defining a step formed in said arcuate body and extending outwardly therefrom to define a bucket rim contacting and sealing surface;

a pour guide, supported by said arcuate body, extending upwardly and outwardly from said arcuate body:

a pressure wall extending downwardly from said pour guide and defining a generally cylindrical wall surface, including a surface tapered towards said interior bucket wall surface; and a plurality of spring clasps extending downwardly from said arcuate body each of said spring clasps including a curved portion and a supporting spring arm, said curved portion being forced against and into contact with said bucket wall between said rim bead and said reinforcing rib, said rim mounted pour spout being snap fit attachable to said bucket rim such that said pressure wall extends into the bucket and is pressed against said interior bucket wall surface by said spring clasps.

2. The rim mounted pour spout set forth in claim 1 wherein said step defines a planar surface which rests upon a portion of a bucket upper rim when said rim mounted pour spout is secured to a bucket upper rim in a non-engaging contact.

3. The rim mounted pour spout set forth in claim 2 wherein said arcuate body defines opposed ends and wherein said plurality of spring clasps includes a spring clasp proximate each of said ends.

4. The rim mounted pour spout set forth in claim 3 wherein said arcuate body defines a curved body which is less than a semi-cylinder in extent such that said ends do not interfere with the vertical position of a bucket handle.

5. The rim mounted pour spout set forth in claim 4 wherein said plurality of spring clasps includes at least one spring clasp positioned generally at the mid-point of said arcuate body between said ends.

6. The rim mounted pour spout set forth in claim 5 wherein said pour guide and said pressure wall combine to form a curved continuous material flow surface.

7. A rim mounted pour spout constructed to engage a substantially cylindrical bucket having a generally cylindrical interior wall surface and an upper rim surface and an outwardly extending rim bead formed on the top of the bucket wall and at least one reinforcing rib encircling and extending outwardly from the bucket wall at a distance from the rim bead, said rim mounted pour spout comprising:

an arcuate body curved to correspond to a bucket rim and cylindrical interior wall surface defining a step formed in said arcuate body and extending outwardly therefrom to define an upper rim contacting and sealing surface which is pressed upon the upper rim surface to provide a seal against the bucket rim;

a pour guide, supported by said arcuate body, extending upwardly and outwardly from said arcuate body terminating in an upper edge;

a pressure wall extending downwardly from said pour guide and defining a generally cylindrical wall surface, including a surface tapered toward and corresponding to the cylindrical interior wall surface of a bucket; and a trio of spring clasps extending downwardly from said arcuate body each of said spring clasps including a curved portion and a supporting spring arm, said curved portions being forced against and in contact with the bucket wall between its rim bead and its reinforcing rib, and each of said spring arms urging their respective curved portions toward said pressure wall, whereby said rim mounted pour spout is snap fit attachable to a bucket rim by the cooperation of said trio of spring clasps to attach and maintain said rim mounted pour spout at a position upon a bucket in which said pressure wall extends into the bucket and is pressed against the bucket wall by said spring clasps.

8. The rim mounted pour spout set forth in claim 7 wherein said step defines a planar surface which rests upon a portion of a bucket upper rim when said rim mounted pour spout is secured to a bucket upper rim in a non-engaging contact.

9. The rim mounted pour spout set forth in claim 8 wherein said arcuate body defines opposed ends and wherein said trio of spring clasps includes a spring clasp proximate each of said ends.

10. The rim mounted pour spout set forth in claim 9 wherein said arcuate body defines a curved body which is less than a semi-cylinder in extent such that said ends do not interfere with the vertical position of a bucket handle.

11. The rim mounted pour spout set forth in claim 10 wherein said trio of spring clasps includes at least one spring clasp positioned generally at the mid-point of said arcuate body between said ends.

* * * * *